United States Patent [19]

Sugar

[11] Patent Number: 4,540,969

[45] Date of Patent: Sep. 10, 1985

[54] SURFACE-METALIZED, BONDED FUSE WITH MECHANICALLY-STABILIZED END CAPS

[75] Inventor: Joseph Sugar, Los Angeles, Calif.

[73] Assignee: Hughes Aircraft Company, El Segundo, Calif.

[21] Appl. No.: 525,759

[22] Filed: Aug. 23, 1983

[51] Int. Cl.[3] ..... H01H 85/16

[52] U.S. Cl. ..... 337/232; 337/228; 337/248; 337/255

[58] Field of Search ..... 337/232, 231, 228, 246, 337/234, 248, 251, 252, 227, 214, 213, 208, 187, 253, 236

[56] References Cited

U.S. PATENT DOCUMENTS

| | | | |
|---|---|---|---|
| 1,716,884 | 6/1929 | Goss | 337/248 |
| 1,861,369 | 5/1932 | Sundt | 337/232 |
| 3,261,951 | 7/1966 | Jacobs | 337/276 |
| 4,158,187 | 6/1979 | Perreault | 337/248 |

FOREIGN PATENT DOCUMENTS

| | | | |
|---|---|---|---|
| 580759 | 9/1946 | United Kingdom | 337/232 |

*Primary Examiner*—Harold Broome

*Attorney, Agent, or Firm*—S. C. Durant; W. J. Benman, Jr.; A. W. Karambelas

[57] ABSTRACT

The body of the disclosed fuse includes connective portions having surface-metalization to which corresponding connective portions of the fusible element are respectively bonded.

A metalization-conducive ceramic may be more-specifically utilized for the fuse body, while those portions of the body which interface with the fusible element may additionally be contoured so as to lessen the severity of element-severance forces otherwise experienced.

When the fuse's connective portions yet-more-specifically comprise the opposite ends of a fuse body which is elongated, end caps may be electrically joined to the surface-metalized fuse ends. An enhanced degree of mechanical stability may also be achieved by further providing stabilizing geometrical expedients for the fuse/cap interface.

42 Claims, 16 Drawing Figures

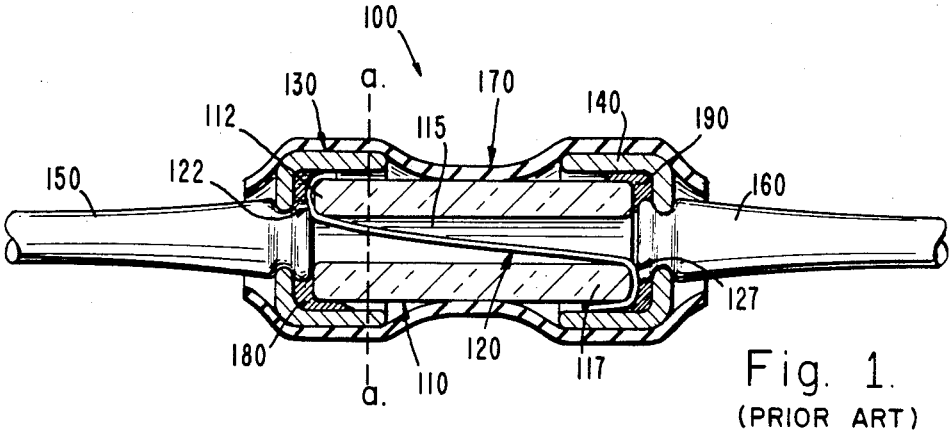
Fig. 1.
(PRIOR ART)
Fig. 2a.
(PRIOR ART)
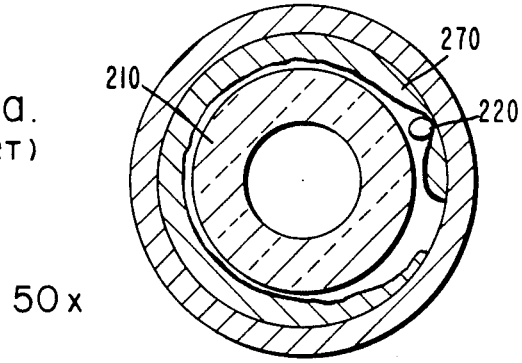
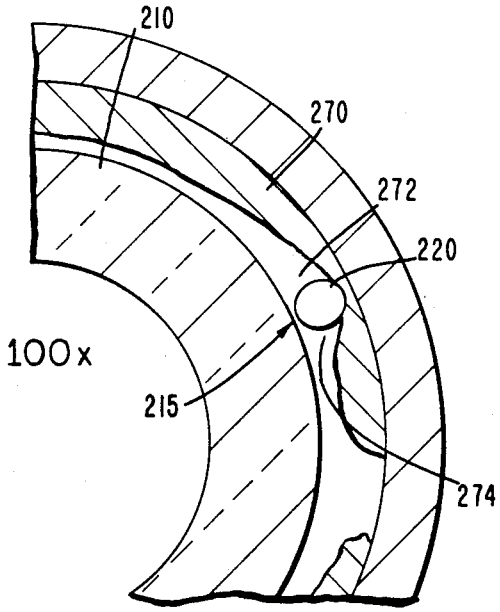
Fig. 2b.
(PRIOR ART)

Fig. 5.
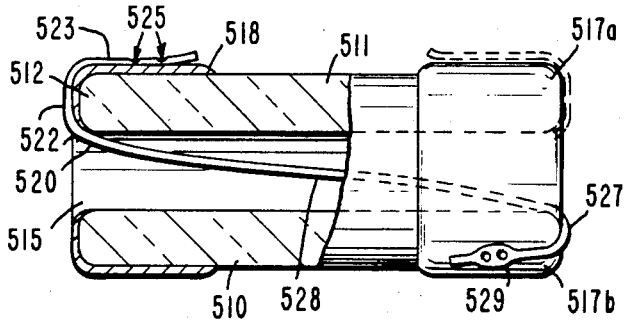
Fig. 6a.
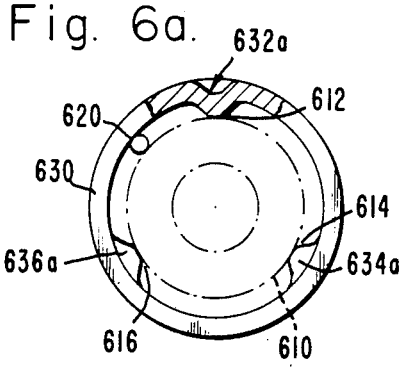
Fig. 6b.
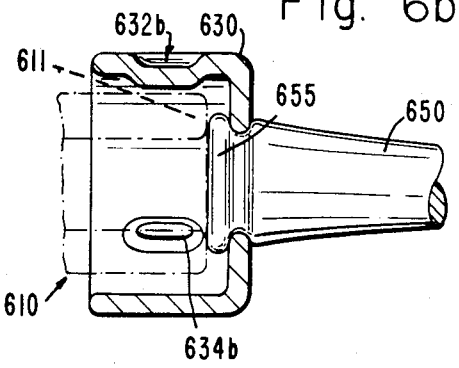
Fig. 6c.
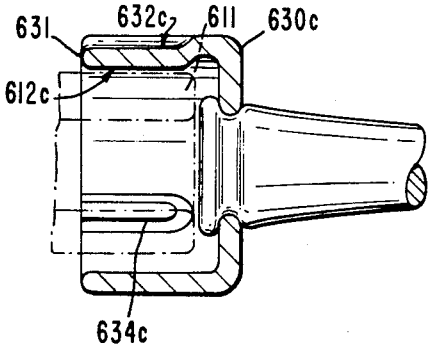
Fig. 6d.
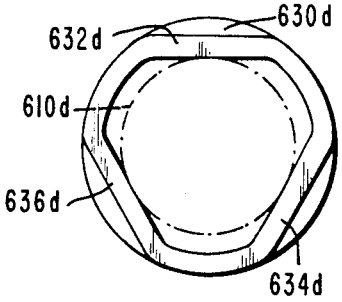
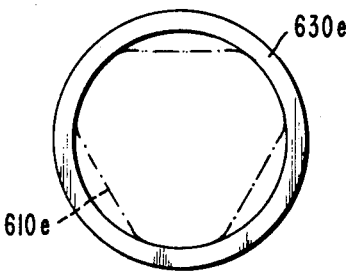
Fig. 6e.

SURFACE-METALIZED, BONDED FUSE WITH MECHANICALLY-STABILIZED END CAPS

BACKGROUND OF THE INVENTION

1. Field of the Invention

The invention relates in general to electrical fuses and in particular to improved construction principles for such fuses.

It is to be noted, however, that while the present invention will be described here with reference to the particularized application of electrical fuses, the invention is not limited to such applications. Those having ordinary skill in the art and access to the teachings of this invention will recognize additional applications within the invention's scope.

2. Description of the Prior Art

FIG. 1 illustrates a cross-sectional view of a typical prior-art fuse 100. The fuse includes a tubular, ceramic body 110 and a wire fusible element 120. Fusible element 120 extends through the hollow central core 115 of fuse body 110 and includes looped ends 122 and 127 respectively folded over fuse-body ends 112 and 117. The body ends and fusible-element loops are encased within respective end caps 130 and 140 which also hold lead wires 150 and 160. Conductive contact is provided by solder 180 and 190. The entire assembly is encased within a surrounding shrink sleeve 170.

Two aspects of such fuses have now been identified as giving rise to a number of shortcomings which have been found to become especially pronounced in the installation stages of the larger assemblies in which the fuses may be employed as component elements. These difficulty-inducing aspects include first, the solder terminations 180 and 190 and second, the inherent configuration of the end caps 130 and 140. The associated consequential problems include both non-uniformities and instabilities in fuse electrical, thermal and mechanical properties. These causal factors and their consequential difficulties will now be discussed in greater detail.

FIGS. 2*a* and 2*b* illustrate the adverse consequences entailed in attempting to form a solder joint between an end cap and a fusible element juxtaposed a ceramic fuse body. FIG. 2*a* represents a 50X transverse cross-sectional view taken along line a—a in FIG. 1, while the enlarged 100X view of FIG. 2*b* focuses more specifically on the vicinity of the fusible element. The ceramic nature of the fuse body 210 does not lend itself to a capillary-type adhesion action with respect to solder 270. As a result, gaps 272 and 274 are typically encountered at the interface between body surface 215, fusible element 220 and solder 270. As is exemplified by the figure, it has been found to be not uncommon for only approximately 30% of the fusible-element surface to be effectively contacted by the adjacently-disposed solder. This unpredictable degree of contact consequentially produces a resistance across the fuse which is non-uniform from one fuse to the next. The resulting variation in inter-fuse electrical properties in turn introduces an element of uncertainty into end-use overall circuit design. It may also be noted that because such solder junctions are typically formed only after the end cap has been inserted over the looped end of the fusible wire, the contacts are not readily susceptible to quality-control inspection.

A second source of difficulty in the prior-art fuse construction concerns the positioning of the end cap around the ceramic body. This situation is schematically illustrated in the transverse cross-sectional view of FIG. 3*a* where the fuse body 310 of a given external diameter $d_1$ is shown to be surrounded by the end cap 330 of internal diameter $d_2$. Interposed between the body and cap is the fusible element 320. The consequential lack of concentricity between the body 310 and the end cap 330 is readily apparent. In practical commercial situations, this lack of concentricity is rendered more pronounced by the typical desire to form the end cap 330 of sufficiently-large internal diameter $d_2$ so as to accommodate fusible elements 320 of different cross-sectional diameters $d_3$ and hence of different breakdown levels.

One problem following from the lack of concentricity is a randomness in the positional distribution of end cap 330 with respect to both the body 310 and the interposed fusible element 320. This randomness introduces a further measure of non-uniformity in the electrical properties of the overall fuse.

An associated problem follows from the readily-destablized nature of the solder-based end junction when the otherwise-completed fuse is subsequently subjected to elevated-temperature operations. Such operations include the application of the shrink sleeve during fuse manufacture, as well as the additional external soldering performed when the fuse is installed within larger assemblies such as printed circuit boards. A common collateral consequence of the elevated temperatures is a remelting of the solder within the fuse end. With mechanical interlock between the various components of the conventional fuse being basically provided by only the interfacing solder and the surrounding shrink sleeve, such remelting has been found to have an adverse effect on the mechanical positioning of the end cap. The lack of concentricity illustrated in FIG. 3*a*, together with the absence of other available physical interlock mechanisms, can produce a post-elevated-temperature condition such as the one illustrated in FIG. 3*b*. Here the readily-alterable nature of the solder junction between the end cap 340 and the body 310 is seen to permit the development of an excessive tilt of end cap 340 with respect to body end 317. Among the disadvantageous consequences of an excessive tilt of this nature are the creation of shearing forces between the diagonally-disposed end-cap portion 342 and the typically-sharp corner portion 318 of fuse-body end 317. Such forces may cause either a reduction in the effective cross-sectional area of the fusible element 320 because of nicking at the 318/342 interposition point, or an actual complete severance. It may also be noted that the typically similarly-sharp corner 319 may likewise produce either nicking or actual severance when the fusible element 320 is subjected to thermally-induced tensile stresses. Such stresses include those commonly encountered in spacecraft when experiencing temperature extremes such as −55° F. or lower.

It is to be further noted that another collateral consequence of such solder remelting is a physical alteration of the previously-discussed junction between the solder and the fusible element. A practically-unavoidable effect of this physical alteration is an associated additional alteration in the electrical characteristics of the junction and hence of the overall fuse.

In view of these disadvantageous properites of the prior-art fuses, a need clearly exists for significant improvements in fuse construction.

SUMMARY OF THE INVENTION

The shortcomings of the prior-art fuses are overcome by the disclosed fuse whose body includes connective portions having surface metalization to which corresponding connective portions of the fusible element are respectively bonded.

A metalization-conducive ceramic may be more-specifically utilized for the fuse body, while those portions of the body which interface with the fusible element may additionally be contoured so as to lessen the severity of element-severance forces otherwise experienced.

When the fuse's connective portions yet-more-specifically comprise the opposite ends of a fuse body which is elongated, end caps may be electrically joined to the surface-metalized fuse ends. An enhanced degree of mechanical stability may also be achieved by further providing stabilizing geometrical expedients for the fuse/cap interface.

BRIEF DESCRIPTION OF THE DRAWINGS

Advantages and aims of the present invention will become apparent from a study of the following specification, especially when considered in conjunction with the accompanying drawings, in which:

FIG. 1 is a cross-sectional view of a typically-constructed prior-art electrical fuse;

FIGS. *2a* and *2b* present enlarged cross-sectional views of the poor nature of the prior art's non-capillary-assisted solder interface with respect to a fusible element interposed between a ceramic fuse body and a surrounding end cap;

FIG. *3a* shows the typical misaligned, non-concentric nature of the relationship between a prior-art fuse body and its associated end cap;

FIG. *3b* illustrates the excessive tilt and consequential generation of fusible-element shearing forces following from the lack of a thermally-stable physical interlock between a fuse body and a nonconcentric end cap;

FIG. *4a* shows various features of the inventive fuse body with its applied metalization layers;

FIGS. *4b* and *4c* present example realizations for the concept of contoured surfaces of fusible-element/fuse-body interface;

FIG. 5 illustrates various aspects of the bonding of a fusible element to the prepared fuse body of FIG. *4a;*

FIGS. *6a, 6b, 6c, 6d* and *6e* respectively present end-cap and fuse-body cross-sectional views of secific realizations for end-cap mechanical-stabilization expedients; and FIGS. *7a* and *7b* present longitudinal and transverse cross-sectional views of a composite electrical fuse constructed in accordance with many of the principles of the present invention.

DETAILED DESCRIPTION OF THE INVENTION

I. Overview

Figure 3A:
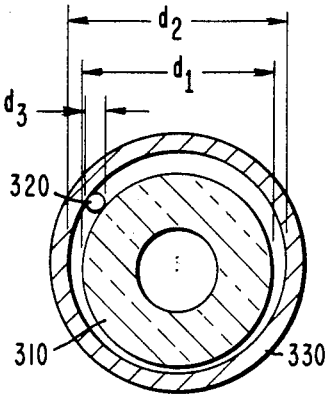
Fig. 3a. (PRIOR ART)
Figure 3B:
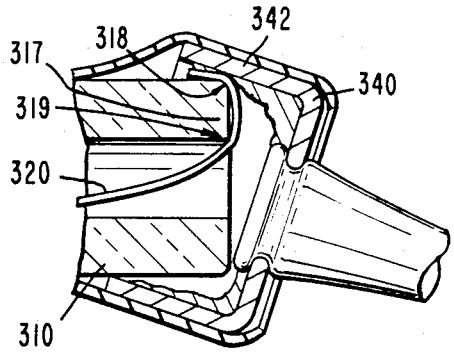
Fig. 3b. (PRIOR ART)
Figure 4A:
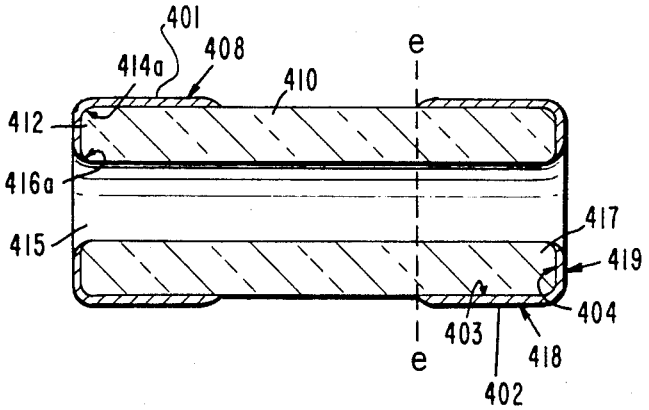

In its more-specific embodiments, the inventive fuse entails an elongated body comprised of a metalization-conducive ceramic material. This body includes contoured, surface-metalized connective ends to which the fusible element is welded and to which mechanically-stabilized-end caps are soldered. The component features of this particularized fuse and the manner in which these features enable the shortcomings of the prior art to be overcome will be individually discussed with reference to FIGS. 4 through 6. FIG. 4 will provide the context for a description of the fuse body and its surface metalization, while the context for a review of the bonding of the fusible element will be provided by FIG. 5. Following an examination with reference to FIG. 6 of the mechanically-stabilized end caps, the detailed description will conclude with a specific-feature summary presented in the context of the composite embodiment illustrated in FIG. 7.

It may be noted parenthetically that in view of the largely-symmetrical nature of many aspects of the preferred form of the inventive fuse, the following discussion will for convenience tend to focus on only a given one of otherwise symmetrically-disposed features.

II. Embodiment Details

A. Fuse Body

The subject electrical fuse basically entails first, a fuse body having first and second connective portions; second, surface metalization applied to these portions; and third, a fusible element having what may for convenience be regarded as third and fourth connective portions respectively bonded to the surface metalization of the first and second connective portions of the fuse body.

With reference to FIG. *4a,* an example embodiment of the subject fuse thus first includes the illustrated body 410. The associated connective portions, to which the below-described fusible element will later be shown to be bonded, appear as respective first and second connective portions 401 and 402. Applied to portions 401 and 402 are the illustrated respective surface-metalization layers 408 and 418.

In view of the component metalization specified to be carried by the fuse body, the body 410 is itself advantageously comprised of a material which while remaining electrically insulative is nevertheless conducive to the adhesion thereon of an exterior metalization layer. Although a number of materials are suitable for this purpose, body 410 may in general be conveniently comprised of a ceramic material. One especially-advantageous ceramic is alumina (aluminum oxide, $Al_2O_3$). For a preferred form of the invention, body 410 comprises an alumina ceramic of at least approximately 92% alumina.

In its volumetric geometry, fuse body 410 may take on a variety of forms. One class of specific forms provides the fuse body with first and second end portions, such as respective end portions 412 and 417 in FIG. 4. In the more-specific context of a fuse body having end portions of this nature, the previously-identified connective portions 401 and 402 can be seen to respectively comprise selected sections of these portions 412 and 417. It may be noted parenthetically that for preferred embodiments of the invention, such end portions are configured to receive end-cap assemblies, as will be further discussed below.

In yet-more-specific embodiments of the invention, it becomes advantageous to provide the fuse body with a substantially-elongated geometry, in which case the end portions may simply become the opposite ends of the fuse body. Body 410 is shown to possess a substantially-elongated, oppositely-disposed-end-portion geometry of this nature.

With regard to making provision for the subsequently-mounted fusible element, it may be noted that as between a fusible element of arbitrary geometry and a fuse body basically of also-arbitrary geometry, it would be possible to simply mount the fusible element on the exterior of an otherwise-essentially-smooth body surface. However, an otherwise-arbitrarily-shaped fuse body may advantageously be provided with a receptacle for the protective carrying of the fusible element. In those preferred instances where the fusible element is given an essentially-elongated shape, the protective receptacle may take the form of an elongated conduit configured as either part of the fuse-body's surface geometry or its interior. Where the fuse body is also more-specifically given not only a likewise-essentially-elongated shape but also an either rectangular or cylindrical volumetric geometry, the elongated conduit is conveniently made in the form of an axial shaft, schematically illustrated in FIG. 4*a* as central shaft 415. With an axial shaft of this nature, body 410 preferably takes a substantially cylindrically-tubular form.

It will be recalled that an examination of the prior-art fuses revealed that the presence of sharp edges at critical portions of the interface between the body 410 and a subsequently-mounted fusible element detrimentally contributed to the generation of shearing forces. With surfaces of critical fusible-element/fuse-body interface being established by those areas of element/body juxapositional contact which would otherwise tend to generate shearing forces, such interface surfaces may accordingly be provided with contoured edges designed to reduce the severity of this interface. In typical specific embodiments, interface surfaces of this nature will be located at the end portions of the fuse body. Thus in order to minimize the generation of shearing-type forces, illustrative interface surfaces 414*a* and 416*a* of end portion 412 are advantageously made to be contoured.

Figure 4B:
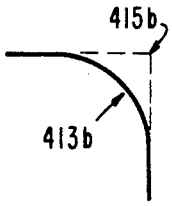
Figure 4C:
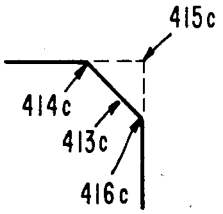

Of the numerous specific geometries which may be employed as practical realizations of such shearing-reduced edge contours, FIGS. 4*b* and 4*c* respectively schematically illustrate the use of first rounded and then chamfered surface portions for the fuse-body ends. FIG. 4*b* shows surface portion 413*b* to be substantially rounded, thus significantly reducing the severity of the surface geometry otherwise presented by conventionally-experienced edge 415*b*. Similarly, FIG. 4*c* illustrates the manner in which the chamfered surface portion 413*c* may be employed to again reduce the severity of the conventionally-experienced edge 415*c* by effectively substituting the more-relaxed edge surfaces 414*c* and 416*c*.

B. Surface Metalization

The previously-referenced surface metalization applied to the connective portions of the fuse body constitutes a second basic feature of the subject electrical fuse.

The metal chosen for the metalization process is preferably of a nature which is conducive to the subsequently-performed bonding of the fusible element to the metalization surface. In a preferred situation where a below-described particular form of welding is to be utilized for this bonding, it is convenient to employ either molybdenum-manganese (commonly referred to as molymanganese) or tungsten as the metalization material.

For the similarly more-specific situation where the fuse body includes end portions configured to receive end caps, the metal is also preferably conducive to the connective mounting of such caps. Because the connective mounting typically includes a solder joint, it is to joints of this nature which the metal should most-specifically also be conducive. It may be noted that the above-identified exemplary molymanganese and tungsten each possess this supplemental conducivity.

Conventional processes may be employed to apply such metalizations to the appropriate portions of the fuse body. In a preferred form of the invention, however, the metalization-application process is specified to include a co-firing of the metalization along with the final curing of the preferred ceramic body. Alternatively, although somewhat less advantageously, the metalization may be baked onto a substantially-finished ceramic body.

The metalization processing itself preferably concludes with the various metalized layers being subjected to a surface-finishing operation designed to provide the metals with both anti-corrosion protection and enhanced bondability to the fusible element. Where the fuse is again more-specifically configured for the mounting of end caps, the surface finishing is preferably designed to also provide enhanced joinability to the associated caps. A variety of plating-type surface finishings may be employed for the simultaneous achievement of these objectives. The conventionally-applied finishing may, for example, more-specifically take the form of either gold over nickel or solder plate over nickel.

The portions of the fuse body selected to receive metalization are, as a minimum, those expected to be contacted by the fusible element. Although it is usually convenient to specify, in the particularized case of an elongated fuse body, for example, that metalization layer 418 be applied to at least the exterior end surface 403, it is often further convenient to provide that the metalization be applied around the entire exterior of the end of the fuse body up to the illustrated depth e—e and include the illustrated extension 419 onto the contoured end surface 404. In a more-specific embodiment of this nature, the fuse's connective portions become simply the entire respective metalized ends.

C. Fusible Element

A third basic feature of the subject electrical fuse is its fusible element. Within the inventive fuse, this element performs the essentially-conventional function of circuit interruption by melting upon overload. While an element which performs this function may take on any number of specific geometries, the element of whatever form will possess at least two connective portions which are to be bonded to the surface-metalized connective portions of the fuse body. For the sake of sequential consistency with those fusebody portions which have previously been ordinally identified as first and second connective portions, the subject portions of the fusible element are in turn identified as third and fourth connective portions. It then becomes convenient to reiterate that for the inventive fuse these third and fourth portions of the fusible element are respectively bonded to the surface metalization associated with the first and second connective portions of the fuse body.

The fusible element may more-generally be regarded as including a plurality of sections, with the elements' connective portions comprising selected segments of such sections. Where, as previously-discussed, the fuse body has been more-specifically configured to include a recetacle adapted to protectively carry the fusible element, it is also more-specifically a selected one of the referred sections which is interposed in the fuse-body receptacle.

It is often convenient, especially where an essentially-elongated fuse body is being employed, to additionally provide that the fusible element likewise be essentially elongated and include a central section. In such a case, a protective receptacle for an associated, substantially-elongated fuse body may comprise an elongated conduit. It then becomes further convenient to provide that it be the fusible element's central section which is interposed in the elongated conduit.

Thus with reference to FIG. 5, the fuse body 510 is seen to be of the preferred, substantially-tubular form which includes a central axial shaft 515. An otherwise-conventional, substantially-elongated fusible element 520, having a first end-section 522, a second end-section 527 and a central section 528 is shown to be interposed in shaft 515 and folded around the previously-described contoured edge surfaces of the fuse body 510.

At contoured fuse end 512, containing the previously-described surface-metalization layer 518, third connective portion 523 of the fusible element is bonded to the given associated segment of the layer 518. (A similar bonding is formed with respect to the fourth connective portion 529 at second fusible-element end 527.) A number of techniques may be employed to effectuate the subject bonding, with one such suitable technique comprising a conventional welding process. The welding may in turn comprise a variety of more-specific forms. A preferred technique utilizes the precision "parallel-gap" type series welding operation made possible by the Model VTA-66 Parallel Gap Weld Head available from the Industrial Products Division (Carlsbad, Calif.) of the Hughes Aircraft Company. Side portion 523 is thus illustrated as being bonded to layer 518 by means of parallel-gap weld 525.

By means of the described bonding, the fusible element becomes securely joined to the fuse body. The bonding thus provides a positive physical interlock between the fusible element and the body, an interlock which is essentially unalterable during subsequent operations involving the ordinary application of elevated processing temperatures. Furthermore, for those instances where the fuse body is configured to receive end caps, the bonding would be completed prior to the mounting of the caps and hence a pre-capping visual inspection of the respective bonds would be readily facilitated.

It may be noted that it may be advantageous to specify that the central section 528 of elongated fusible element 520 be supplied at fabrication with sufficient slack so as to provide tolerance of subsequently-experienced temperature fluctuations. Such tolerance helps prevent alterations in electrical properties which result from fusible element cross-sectional changes caused by differentials in the thermal-expansion characteristics between the typically-metallic fusible element and the typically-ceramic fuse body.

It may be further noted that in certain circumstances mass production of the subject fuse may be facilitated by alternatively looping element end section 527 around body-end segment 517*a* instead of around segment 517*b*. With both end sections of the fusible element disposed on a common side 511 of the fuse body, the bonding of both ends could then be effectuated from a single side of the fuse. A single-side bonding of this nature could facilitate production by eliminating the necessity for a typically less-efficient intermediate step of body rotation between the bonding of one end and the next.

D. Stabilized End Caps

In the more-specific situations where the fuse body includes first and second end portions, such portions may yet-more-specifically be configured to respectively receive first and second end-cap assemblies. Such assemblies connectively encase the associated connective portions of the fusible element. The encasement is "connective" in that when the assemblies are mounted on the respective end portions, an electrical connection is established between the assemblies and the respective connective portions of the given element.

The particular means utilized to effectuate this electrical connection may tend to be a function of the specific characteristics of a given actual embodiment for the subject fuse. It may be noted parenthetically, however, that in view of the previously-discussed bonding between the fusible element and the metalization, the required cap-to-fusible-element connection may be established "indirectly" by way of an electrical connection between the assemblies and the appropriate metalization layers. Thus, for example, in larger-scale embodiments where the given end portions possess adequate compressive strength, the subject connection may be established by simply crimping the assembly end caps onto the associated end portions so that the crimped portions of the caps physically contact either the fusible element itself or at least the associated metalization. In smaller-scale embodiments where the end portions lack the requisite compressive strength, as well as in embodiments of arbitrary scale where auxiliary considerations such as end-portion hermeticity are operative, a solder joint between the end-cap assembly and either or both of the fusible element and the metalization may, for example, alternatively be employed.

The end-cap assembly itself may take a variety of specific forms. Such forms will typically include a separately-identifiable end cap. This end cap may more-specifically be configured to both receive the terminal end of a lead wire and hold this wire substantially juxtaposed the fuse-body end portion on which the assembly is mounted. Where the end cap is specifically configured in this fashion, the end-cap assembly may be regarded as including both the end cap itself and the lead wire. Furthermore, for those specific embodiments where a solder joint is employed as the means which establishes the requisite electrical connection, the assembly may similarly be regarded as including the solder joint as well.

Although the general nature of the cap assemblies will be further discussed in the context of the composite embodiment illustrated in FIGS. 7*a* and 7*b*, certain unique aspects of the preferred forms of the caps themselves will now be described with reference to FIGS. 6*a*, 6*b*, 6*c*, 6*d* and 6*e*. A given fuse-body end portion and its associated mounted assembly may be regarded as establishing a fuse/cap interface. In the preferred form of the invention, this interface is configured so as to generally include appropriate geometrical mechanisms for stabilizing the mechanical positioning of the given assembly on the associated end portion. Such stabilization mechanisms may be realized by means of impressions integrally formed within the caps themselves. Of the yet-more-specific realizations for the stabilization mechanisms in general and for the impressions in particular, indentations or flats integrally formed in the cap may be employed. Example indentations of this nature are illustrated in FIGS. 6*a* and 6*b*, while example flats are presented in FIG. 6*d*.

In the transverse cross section of FIG. 6*a*, the end cap 630 is illustrated as encasing an end of fuse body 610. Cap 630 is shown to include a plurality of integral impressions whose specific forms are the illustrated indentations 632*a*, 634*a* and 636*a* which abut the fuse body at respective interface surfaces 612, 614 and 616. The described impressions are preferably configured so as to be mutually symmetrically disposed around the perifery of the encased fuse-body end portion when the given cap is thereon mounted. It may be noted that in the specific situation of a tubular fuse body, the symmetrical periferal encasement may typically take the illustrated form of a circumferential disposition at approximately 120° intervals. The inherent stability of the resulting concentric relationship between the end cap and the fuse body is readily apparent. A typical connective interposition for fusible element 620 is also illustrated.

A longitudinal cross-sectional view of this end-cap configuration is presented in FIG. 6*b*. End cap 630 is again shown to be encasing an end portion 611 of fuse-body 610 while also shown to be of the specific type which is configured to receive terminal end 655 of lead wire 650 and hold this wire end substantially juxtaposed the fuse-body end portion 611. Indentations 632*b* and 634*b* are two of the typically three symmetrically-disposed stabilizing indentations. Of the various alternative cross-sectional forms again possible for the impressions in general and the indentations in particular, the indentations 632*c* and 634*c* are shown in FIG. 6*c* to be of a preferred, elongated variety extending to edge 631 of cap 630*c*, thus creating, for example, an extended-surface interface 612*c* between the end cap and the fuse-body end portion 611.

In FIG. 6*d* is shown the alternative realization in which flats 632*d*, 634*d* and 636*d*, integrally-formed within end cap 630*d* and abutting fuse body 610*d*, are the specific forms of the stabilizing impressions. By analogy to the elongated impressions illustrated in the cross-sectional view of FIG. 6*c*, the flats of FIG. 6*d* may similarly be of an elongated nature.

An alternative of a slightly-different specific nature is presented in FIG. 6*e*. Here the geometrical stabilization is provided by a specially-configured cross section for fuse body 610*e* instead of by alterations for end cap 630*e*. Other substantially-equivalent stabilization geometries for both the fuse body and the end caps will be readily apparent.

E. Composite Embodiment

Figure 7A:
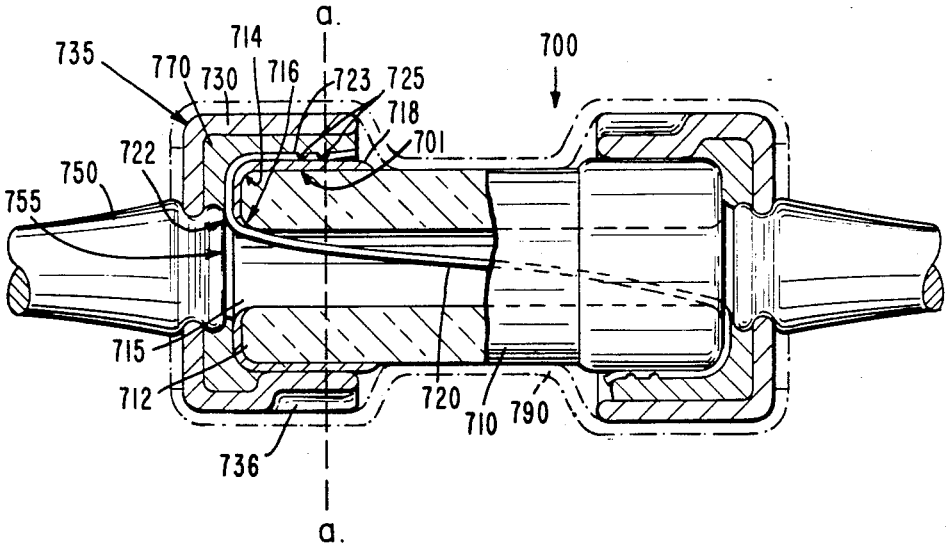
Figure 7B:
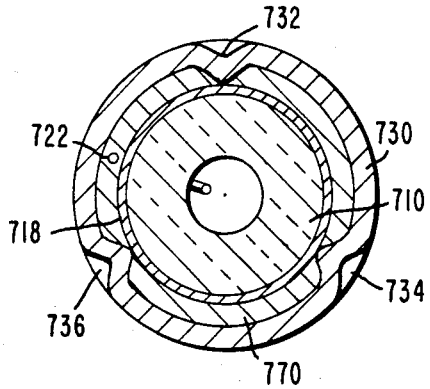

A composite preferred realization of an electrical fuse constructed in accordance with principles of the present invention is illustrated in FIGS. 7*a* and 7*b*. The longitudinal cross-sectional view of FIG. 7*a* shows the fuse 700 with elongated tubular body 710, axial shaft 715 and elongated fusible element 720. First end-cap assembly 735 is shown as including first end cap 730, solder medium 770 and lead wire 750 with terminal end 755 held substantially juxtaposed first fuse-body end 712. Cap 730 is seen to contain the elongated stabilizing indentation 736, while the connective portion 723 of the fusible-element end 722 is shown to be bonded, by means of parallel-gap weld 725, to metalization 718 formed around contoured end surfaces 714 and 716 and onto connective surface 701. Solder medium 770 electrically joins end cap 730 to metalization layer 718 and to fusible-element end 722. Shrink sleeve 790 encases the composite fuse.

With reference to the transverse cross-sectional view of FIG. 7*b*, taken along line a—a of FIG. 7*a*, end cap 730 is shown to be stabilized over the end of fuse body 710 by means of integrally-formed impressions 732, 734 and 736. Electrically joining end cap 730 both to metalization surface 718 and to interposed fusible element end 722 is the joining medium comprised of solder 770. The metalization surface 718, by means of its induced capillary action, is shown to have effectuated not only a uniform electrical interface between the cap 730, the surface 718 and the interposed fusible element end 722, but also a fuse-body-end seal of significantly-enhanced hermeticity.

III. Claims

The preceding description has presented in detail exemplary preferred ways in which the concepts of the present invention may be applied. Those skilled in the art will recognize that numerous alternatives encompassing many variations may readily be employed without departing from the spirit and scope of the invention as set forth in the appended claims, in which:

What is claimed is:

1. An electrical fuse comprising:

(A) an elongated body defining an elongated conduit therethrough and having first and second external connective portions;

(B) surface metalization applied to said connective portions; and (C) a fusible element having third and fourth connective portions, said third and fourth portions being respectively welded to the surface metalization of said first and second portions and including a central section disposed in said conduit and, (D) first and second end cap assemblies, respectively mounted on said fusible element and said first and second connective portions.

2. A fuse according to claim 1 in which:
said fuse body comprises a ceramic material which is conducive to the application of said surface metalization.

3. A fuse according to claim 2 in which:
said ceramic material comprises alumina.

4. A fuse according to claim 3 in which:
said alumina ceramic comprises at least approximately 92% alumina.

5. A fuse according to claim 1 in which:
said metalization comprises molymanganese.

6. A fuse according to claim 1 in which:
said metalization comprises tungsten.

7. A fuse according to claim 2 in which:
said metalization is co-fired with said ceramic material.

8. A fuse according to claim 2 in which:
said metalization has a surface finish applied thereto.

9. A fuse according to claim 1 in which:
said metalization is finished with gold over nickel.

10. A fuse according to claim 1 in which:
said metalization is finished with solder plate over nickel.

11. A fuse according to claim 1 in which:
said weld comprises a parallel-gap weld.

12. A fuse according to claim 1 in which:

(A) said fuse body includes surfaces of critical interface between the fusible element and the fuse body; and (B) such surfaces include contoured edges.

13. A fuse according to claim 12 in which:
said contoured edges include substantially-rounded portions.

14. A fuse according to claim 12 in which:
said contoured edges include substantially-chamfered portions.

15. A fuse according to claim 1 in which:
said fuse body includes first and second end portions, with said first and second connective portions respectively comprising selected sections of said first and second end portions.

16. A fuse according to claim 15 further including:
first and second end-cap assemblies, respectively mounted on said first and second fuse-body end portions and each connectively encasing the associated connective portion of said fusible element.

17. A fuse according to claim 16 in which:
(A) each of said first and second fuse-body end portions and the associated mounted end-cap assemblies establish respective first and second fuse/cap interfaces; and
(B) each of said interfaces includes geometrical means for stabilizing the positioning of the associated end-cap assembly on the associated fuse-body end portion.

18. A fuse according to claim 17 in which:
(A) each of said assemblies includes an end cap; and
(B) said geometrical means comprise impressions integrally formed in each of said end caps.

19. A fuse according to claim 18 in which:
said impressions comprise elongated indentations.

20. A fuse according to claim 18 in which:
said impressions comprise elongated flats.

21. A fuse according to claim 18 in which:
each of said caps include a plurality of said impressions, configured so as to be mutually symmetrically disposed around the periphery of the associated fuse-body end portion when the given cap is thereon mounted.

22. A fuse according to claim 16 in which:
(A) each of said end-cap assemblies includes a lead wire having a terminal end; and
(B) each of said assemblies is configured to hold the associated terminal end substantially juxtaposed the associated fuse-body end portions.

23. A fuse according to claim 16 in which:
each of said cap assemblies includes a solder joint.

24. A fuse according to claim 1 in which:
(A) said fuse body is substantially tubular; and
(B) said elongated conduit comprises an axial shaft.

25. A fuse according to claim 1 in which:
said fusible element is slacked during fuse manufacture so as to provide thermal tolerance of subsequently-experienced temperature fluctuations.

26. A fuse according to claim 1 in which:
said fusible element is substantially elongated.

27. A fuse according to claim 1 in which:
said fuse body is substantially elongated.

28. A fuse according to claim 1 in which:
said fuse body is substantially tubular.

29. An electrical fuse comprising:
(A) an elongated body, said body comprising a ceramic material of at least approximately 92% alumina, said body having opposite first and second ends, each of said ends having contoured interface edges;
(B) surface metalization applied to selected portions of said first and second ends;
(C) an elongated fusible element having first and second end-sections, each such section being bonded to the surface metalization of a given selected portion on said respective first and second ends of said fuse body, while also being juxtaposed the contoured edges of the given fuse-body end; and
(D) first and second end-cap assemblies respectively mounted on said first and second fuse-body ends and connectively encasing said respective first and second fusible-element ends; with
(E) each of said assemblies including end caps having integrally-formed impressions for stabilizing the mechanical positioning of the cap assembly on the associated end, with said impressions being configured so as to be mutually symmetrically disposed around the periphery of the associated fuse-body end when the given cap is thereon mounted.

30. A fuse according to claim 29 in which:
said fuse-body-end contoured edges include substantially-rounded portions.

31. A fuse according to claim 29 in which:
said fuse-body-end contoured edges include substantially-chamfered portions.

32. A fuse according to claim 29 in which:
said metallization comprises molymanganese.

33. A fuse according to claim 29 in which:
said metalization comprises tungsten.

34. A fuse according to claim 29 in which:
the bonding of the individual end sections of said fusible element to the respective metalization portions comprises a weld.

35. A fuse according to claim 34 in which:
said weld comprises a parallel-gap weld.

36. A fuse according to claim 29 in which:
said end-cap-stabilizing symmetrically-disposed impressions comprise elongated indentations.

37. A fuse according to claim 29 in which:
said end-cap-stabilizing symmetrically-disposed impressions comprise elongated flats.

38. A fuse according to claim 29 in which:
(A) each of said end-cap assemblies includes a lead wire having a terminal end; and
(B) each of said end-cap assemblies is configured to hold the associated terminal end substantially juxtaposed the associated fuse-body end.

39. A fuse according to claim 29 in which:
each of said cap assemblies includes a solder joint.

40. A fuse according to claim 29 in which:
(A) said elongated fuse body includes an elongated conduit adapted to protectively carry the fusible element; and
(B) said elongated fusible element includes a central section interposed in said conduit.

41. A fuse according to claim 40 in which:
(A) said fuse body is substantially tubular; and
(B) said elongated conduit comprises an axial shaft.

42. A fuse according to claim 29 in which:
said fusible element is slacked during fuse manufacture so as to provide thermal tolerance of subsequently-experienced temperature fluctuations.

* * * * *